United States Patent [19]

Kreahling et al.

[11] 4,301,107

[45] Nov. 17, 1981

[54] MELT-SPINNING A PLURALITY OF ACRYLONITRILE POLYMER FIBERS

[75] Inventors: Robert P. Kreahling; Ronald E. Pfeiffer, both of Pensacola, Fla.

[73] Assignee: American Cyanamid Company, Stamford, Conn.

[21] Appl. No.: 85,078

[22] Filed: Oct. 23, 1979

Related U.S. Application Data

[63] Continuation of Ser. No. 938,199, Aug. 30, 1978, abandoned, which is a continuation-in-part of Ser. No. 798,202, May 18, 1977, abandoned.

[51] Int. Cl.³ ..... D01F 7/00

[52] U.S. Cl. ..... 264/206; 264/210.7

[58] Field of Search ..... 264/206, 210.7

[56] References Cited

U.S. PATENT DOCUMENTS

| | | | |
|---|---|---|---|
| 4,163,770 | 8/1979 | Povoroff | 264/206 |
| 4,205,039 | 5/1980 | Streetman et al. | 264/206 |
| 4,219,523 | 8/1980 | Prosoff | 264/206 |
| 4,220,616 | 9/1980 | Pfeiffer et al. | 264/206 |
| 4,220,617 | 9/1980 | Pfeiffer et al. | 264/206 |

FOREIGN PATENT DOCUMENTS

| | | | |
|---|---|---|---|
| 2403947 | 8/1974 | Fed. Rep. of Germany | 264/206 |
| 51-60734 | 5/1976 | Japan | 264/206 |

*Primary Examiner*—Jay H. Woo

*Attorney, Agent, or Firm*—Frank M. Van Riet

[57] ABSTRACT

A process for preparing an acrylonitrile polymer fiber is disclosed wherein melt-spun acrylonitrile polymer filaments are maintained in a stretchable state as spun, stretched in at least two stages while maintained in such stretchable stage, the first stage being at a stretch ratio of up to about 5 and the subsequent stretch being at a stretch ratio greater than that of said first to provide a total stretch ratio of at least about 25.

5 Claims, 3 Drawing Figures

F
G
B
C
I
II
III
D
A
E
IV
TEMPERATURE °C
0
% WATER
10

F
G
B
C
A
E
225
200
175
150
125
TEMPERATURE °C
10
20
30
40
50
60
% WATER 225
200
175
150
125
TEMPERATURE °C
F
G
B
C
A
E
10
20
30
40
50
60
% WATER 225
200
175
150
125
TEMPERATURE °C
F
G
B
C
A
E
10
20
30
40
50
60
% WATER

MELT-SPINNING A PLURALITY OF ACRYLONITRILE POLYMER FIBERS

CROSS-REFERENCE TO RELATED APPLICATION

This is a continuation of Application Ser. No. 938,199 filed Aug. 30, 1978, now abandoned which application is in turn a continuation-in-part of Application Ser. No. 798,202, filed May 18, 1977 and now abandoned.

This invention relates to an improved process for preparing an acrylonitrile polymer fiber. More particularly, this invention relates to a process for preparing an acrylonitrile polymer fiber wherein melt-spun filaments of acrylonitrile polymer are maintained in a stretchable state as spun, stretched at a stretch ratio of at least about 25 in at least two stages of stretching while maintained in such stretchable state.

Acrylonitrile polymer fibers are currently provided commercially by wet or dry spinning procedures wherein the polymer is dissolved in a suitable solvent and extruded into a medium which coagulates the polymer in fiber form. When the coagulating medium is a heated gas which causes evaporation of the polymer solvent, the process is that of dry spinning. When the coagulating medium is a liquid which dilutes and washes out the polymer solvent the process is that of wet spinning. While such processes provide desirable fibers, the required use of a polymer solvent is undesirable due to the problem of solvent removal and recovery. The solvents employed are of such a nature as to cause environmental pollution problems if not recovered from the process. Removal of polymer solvent from the resulting fiber is not always complete at the completion of the fiber-making process and residual solvent may be exuded in subsequent hot-wet fiber treatments, such as dyeing, thus giving rise to the environmental pollution problems subsequent to the fiber making process. Therefore it would be very beneficial to extrude acrylonitrile polymer-water mixtures since this would eliminate the steps and costs expended in solvent recovery and the pollution problems associated with solvent use.

It was previously known from U.S. Pat. No. 2,585,444 issued Feb. 12, 1952 to C. D. Coxe that mixtures of acrylonitrile polymer and water when extruded under conditions of elevated temperature and pressure resulted in fibrillar materials suitable for making paper, or in strands of fused and sintered or foamed particles. They have not resulted in filaments suitable for textile purposes as is stated in U.S. Pat. No. 3,984,601, issued Oct. 5, 1976 to R. H. Blickenstaff and assigned to the same assignees as the Coxe patent. Coxe clearly failed to teach the requirement for a specific amount of water to provide a single phase fusion melt. As a result, the product obtained is sintered, non-homogeneous, pock-marked and has poor elongation, low tenacity, and poor properties in general.

In U.S. Pat. No. 3,388,202 issued June 11, 1968 to R. E. Opferkuck, Jr. and O. C. Ross, it is disclosed that acrylonitrile polymers can be converted into a melt phase by heating such a polymer in the presence of moisture to elevated temperatures above the boiling point of water and compressing at pressures above atmospheric to prevent water from boiling. However, the patentees state that when high pressures are employed, it is difficult to perform some extrusion operations such as spinning textile filaments. The patent then teaches the use of a latent solvent for the polymer that has a high dielectric constant and a high boiling point to obviate the use of pressure. Although the patent states that textile filaments can be spun from the melt by conventional melt-spinning techniques, the filaments of textile denier provided by the reference do not have acceptable physical properties for textile purposes, in spite of the use of solvent.

In the Blickenstaff patent cited above, there are disclosed films and filaments spun from substantially single-phase compositions comprising polymers or copolymers of at least 80% or more acrylonitrile. The filaments are characterized by a sheath-core structure, a density gradient across the sheath, a striated surface, and a luster source ratio related to reflective interfaces. It is not indicated what advantages in fiber properties result from this combination of characteristics. The process involves preparing a single-phase fusion melt and extruding such melt into the atmosphere or a spinning chamber pressurized with air or air-water vapor. Filament stretching is done in a separate step after spinning by drawing in saturated steam. Fiber properties in the range of deniers suitable for textile applications are deficient, particularly with respect to loop properties, except when using small amounts of added polymer solvent as claimed by Goodman et al.

In U.S. Pat. No. 3,896,204, issued July 22, 1975 to A. Goodman and M. A. Suwyn, there is disclosed a process for improving the loop properties of the Blickenstaff fiber by incorporating a small amount of a compatible solvent for the polymer. Processing details are the same as those employed by Blickenstaff, except for the provision of the compatible polymer solvent. While the loop properties are improved somewhat by the Goodman et al. process, the requirement for a compatible polymer solvent gives rise to the pollution or recovery problems previously described.

Thus, while there has been certain activity with respect to melt-spinning acrylonitrile polymer fibers, there still remains the need for improved processes for melt-spinning acrylonitrile polymer fibers that provide fiber of improved properties for textile uses without the use of polymer solvent and reduce energy requirements for processing.

In accordance with the present invention, there is provided an improved process for melt-spinning an acrylonitrile polymer fiber which comprises: extruding a single phase fusion melt of an acrylonitrile polymer having a number average molecular weight in the range of about 16,000 to 45,000 and water through a spinnerette to form a plurality of filaments directly in a steam-pressurized solidification zone wherein the temperature, pressure, and saturation of steam are maintained under conditions such that said filaments solidify, remain in a stretchable state sufficient to achieve a total stretch ratio of at least about 25 relative to the linear flow of said fusion melt through said spinnerette, and the amount of water retained in said filaments is sufficient to maintain the filaments in a plastic state; stretching said filaments while in said solidification zone at a total stretch ratio of at least about 25 relative to the linear flow of said fusion melt through said spinnerette to provide fiber, said stretching being accomplished in at least two stages; the first stage being at a stretch ratio of up to about 5 and the subsequent stage being at a stretch ratio greater than that of said first stage.

The process of the present invention provides acrylonitrile polymer fiber of superior physical properties for textile uses and does so without the need for any polymer solvent in processing, thus avoiding the problems of environmental pollution or solvent recovery. The present process, by spinning the fusion melt directly into a steam-pressurized solidification zone wherein orientation stretching is effected, reduces energy requirements by stretching the nascent extrudate in conjunction with spinning rather than by added separate step requiring increased energy expenditures. By conducting the stretching step as indicated, the present process enables a wide range of filament deniers to be achieved with a given orifice diameter and enables a wider range of stretch ratios to be readily achieved than is practical by other procedures. The obtainment of orientation stretching in conjunction with extrusion reduces the size of processing equipment required and provides space savings for a given level of fiber production or enables greater levels of fiber production to be effected in a given area of space. By eliminating certain processing steps required in the prior art methods, the present process can also increase the production level of fiber in a given time period. Other advantages of the process of the present invention will become apparent from the detailed description thereof which follows.

One of the critical features of the process of the present invention involves the conditions that are maintained in a steam-pressurized solidification zone into which the fusion melt is directly spun. The specific conditions that are maintained are those which effect solidification of the molten polymer composition but maintain the nascent filments in a readily stretchable state. By a "readily stretchable state" is meant that the nascent filaments can be drawn at a stretch ratio of at least about 25 relative to the linear flow of fusion melt through the spinnerette without breakage of an intolerable number of filaments being processed. Alternatively, the stretchable state may be considered as a plastic state wherein the temperature of the polymer composition is below the minimum melting point thereof but above the second order glass transition temperature thereof. The specific conditions that enable the desired stretch ratio to be accomplished are such that: the temperature of the nascent filaments is below the minimum melting temperature of the melt $T_m$, but high enough to provide the necessary stretchability; the steam pressure maintained in the solidification zone is sufficient to provide the filaments at the temperature defined and to maintain the rate of evaporation of water from the nascent filaments substantially equal to the rate of diffusion of water vapor through the nascent filaments so as to maintain a substantially uniform composition profile across the cross-section of the nascent filaments while they are within the soldification zone; and the steam used to pressurize the solidification zone is of sufficient temperature and saturation to maintain the surface layer of the nascent filaments sufficiently moist to minimize skin formation during stretching of the individual filaments.

If the conditions are maintained in the solidification zone as indicated, the nascent filaments while in the solidification zone will be stretchable at a stretch ratio of at least about 25, and, generally in the range of stretch ratios of about 25 to 250, preferably about 35 to 150. By maintaining the proper temperature in the solidification zone, the nascent filaments will remain in a plastic state suitable for obtaining the desired stretch ratio. Maintaining the proper steam pressure in the solidification zone will not only provide the necessary temperature to maintain the nascent filaments in a stretchable state but will also maintain a relatively uniform water content within the composition of the nascent filaments to enhance stretchability thereof. The use of steam of sufficient temperature and saturation will maintain the surface layer of the nascent filaments moist so as to minimize skin formation and enable high stretch to be achieved, while at the same time providing a relatively smooth surface on the resultant individual filaments. It is believed that the single, most deleterious factor affecting stretching of the nascent filaments is the premature drying out of the surface layer thereof which leads to a significant skin-, or sheath-layer of polymer composition on the individual filaments that resists stretching and necessitates additional steps of after-drawing, or after-stretching to effect minimal orientation of the filaments for textile uses, thus complicating processing, requiring additional expenditures of energy and resulting in fiber properties that are less than desirable.

As indicated above, the conditions to be maintained in the steam-pressurized zone are those that provide the nascent filaments in a stretchable state such that the filaments can be drawn at a stretch ratio of at least about 25 relative to the linear flow of fusion melt through the spinnerette. It is not possible to specify in any generic manner the ranges of actual steam pressure necessary for each and every acrylonitrile polymer composition contemplated by the present invention because such pressures are influenced by many variables such as the polymer composition and its characteristics, the water content of the single phase fusion melt, and the like. These specific variables affect differently the steam pressure requirements among the useful acrylonitrile polymers contemplated with the result that any broad range of steam pressures recited would inherently encompass certain areas of such range wherein many of the acrylonitrile polymers contemplated would individually be inoperative. Conversely, a statement of a narrow range of pressures operative with certain specified acrylonitrile polymers would fail to properly indicate those operative steam pressures for numerous other acrylonitrile polymers processable by the present invention. Thus, the range of effective pressures useful with one acrylonitrile polymer may extend well beyond the range of effective pressures useful with another polymer of acrylonitrile. Even with copolymers of the same comonomers, the steam pressure requirements may vary widely as comonomer contents vary. Therefore, the only accurate manner by which the steam pressure necessary in the steam-pressurized solidification zone to achieve the specified stretching can be determined is by a preliminary run following the principles outlined above.

For example, the following tabulation indicates the steam pressure ranges necessary for processing copolymers of acrylonitrile (AN) and methyl methacrylate (MMA) in which the proportions of the comonomers vary but processing is carried out in an identical manner on large numbers of filaments in accordance with the process of the present invention, percentages by weight:

PROCESSING CONDITIONS FOR AN/MMA COPOLYMERS

| AN (%) | MMA (%) | $T_m$ | $P_m$ | Solidification Zone Steam Pressure (PSIG) |
|---|---|---|---|---|
| 85.5 | 14.5 | 148 | 50 | 6–22 |
| 89.3 | 10.7 | 154 | 61 | 12–24 |
| 92.0 | 8.0 | 161 | 75 | 15–28 |

Notes:
$T_m$ = minimum melting point, °C., 18% water
$P_m$ = Steam pressure of $T_m$, PSIG From the above tabulation, it can be readily appreciated that as the composition of the copolymer varies, the steam pressures required for a particular copolymer vary and a pressure range specified for one copolymer would not be suitable for another copolymer. Similar comparisons for other copolymers involving different comonomers, among themselves or taken with other different copolymers, do not lead to a generic expression of the useful operating steam pressures in the solidification zone that is pertinent for all acrylonitrile polymer compositions contemplated.

The conditions to be maintained in the solidification zone, as indicated above, are those obtained by employing steam of sufficient temperature, pressure, and saturation therein. The exact steam pressure will be influenced by the various other conditions selected, as indicated, and is selected to achieve the necessary draw-down or stretch within the solidification zone to achieve sufficient orientation to provide textile fiber, i.e., fiber having sufficient orientation to provide those properties useful in textile applications and filament deniers in the range of about 1 to 20. The steam conditions are generally at values which allow a total stretch ratio of at least about 25 preferably about 35 to 150 relative to the linear flow of fusion melt through the spinnerette.

Although the specific steam pressures used in the solidification zone cannot be specified with particularity to cover all of the individual acrylonitrile polymers contemplated by the present invention, the useful range is from about 5 to 125 pounds per square inch guage (PSIG), with specific portions of the broad range operative with particular polymers. It is generally preferred to employ saturated steam, although some variations above and below full saturation may be used. Polymer compositions of higher melting temperatures will require higher steam pressures, while those of lower melting temperatures will require lower steam pressures. An alternative indication of the useful steam pressure is as a percentage of the steam pressure developed at the temperature required to provide the melt. In the present process, this value will generally be from about 10 to about 70 percent, preferably about 10 to about 50 percent, of the steam pressure corresponding to the minimum melting point of the polymer-water composition. It is to be understood, however, that the suggested values of steam pressure or of the percentage of steam pressure corresponding to the minimum melting point are merely guides to follow in arriving at the effective operating pressure and that in some instances the effective operating pressure may fall outside the general ranges suggested.

As can be appreciated from the above discussion of the conditions maintained in the steam-pressurized solification zone, three essential features of the nascent filaments must be maintained to achieve the desired stretch ratio within the solidification zone, i.e., its temperature, its water content, and the distribution of its water content throughout its filament structure. The acrylonitrile polymer alone does not have the capability of forming a melt at a temperature below its deterioration or degradation temperature. Water is necessary to achieve the melt at safe temperatures below those at which deterioration or degradation becomes significant. Once the composition of polymer and water has been heated to a sufficient yet safe temperature, a new entity arises which is a homogeneous melt of polymer and water. Processability of this new entity within the steam-pressurized solidification zone is influenced by the three essential features mentioned. The temperature must be low enough to solidify the melt but high enough to maintain the composition in plastic state. The water content must be sufficient to provide a plastic state at the temperature at which processing is to conducted. The water content must also be uniformly distributed throughout the filament composition so that uniform plasticity is provided throughout the filament structure. The present invention conducts processing to obtain full orientation stretching within the solidification zone under conditions such that the temperature, water content, and distribution of water content are optimized to achieve such processing.

Another critical feature of the present invention is that of effecting the necessary total stretch specified in at least two stages, each within the steam-pressurized solidification zone maintained under the conditions discussed above. In a first stage, draw-down stretch from the spinnerette orifices to a first take-up means may be effected at a stretch ratio which is less than about 5.0. In a subsequent stage, additional stretching is effected at a stretch ratio greater than that of said first stage. However, for purposes of smooth operability and efficient processability, including unexpectedly better fiber properties, it is particularly preferred to conduct the first stage of stretching at a stretch ratio in the range of about 1.5–3.5, relative to the linear flow of fusion melt through the spinnerette. The balance of the total stretch is then achieved with at least one additional stage of stretching. If more than two stages of stretch are employed, the total stretch may be conveniently distributed among the stages but the first must be within the above range. In any event, the stretch effected in the subsequent stage must be greater than the stretch effected in the first stage. For example, if a stretch ratio of 40 is desired, the stretch ratio in the first stage could be about 4 and the stretch level in the second stage could be about 10, the total stretch imparted being $4\times10$ or 40.

An unexpected advantage that arises by conducting the stretch in at least two stages in accordance with the process of the present invention is that at the same level of total stretch, fiber provided by the process of the present invention has improved properties over fiber provided by other melt-spinning procedures. For example, fiber processed by the process of the present invention at a total stretch ratio of 43.5 achieved in two stages has better properties than a fiber of the same polymer processed at a total stretch ratio of 85 in a single stage of stretching. This result is highly surprising since all stretching is conducted in the same solidification zone into which the nascent filaments are spun.

A third optional step of the present invention is the relaxation step that is performed on the stretched filaments subsequent to the orientation stretching. This relaxation step eases the tension created by the stretch and results in shrinkage of the oriented fiber. This relaxation step may be carried out in steam under pressure or by means of dry heat. The extent to which relaxation occurs may be reflected in the amount of filament shrinkage which occurs, the filament denier increasing as a result of such shrinkage. It is possible to conduct the relaxation within the steam-pressurized solidification zone by suitable modification thereof.

The acrylonitrile polymers comprise homopolymers and copolymers of acrylonitrile. Respecting the copolymers, they will contain from about 50 to 99 weight percent of acrylonitrile and, correspondingly, from about 50 to 1 weight percent of one or more monomers copolymerizable therewith. Preferably, the acrylonitrile copolymer will contain from about 75 to about 95 weight percent of acrylonitrile and, correspondingly, from about 25 to 5 weight percent of one or more copolymerizable monomers. Such monomers include acrylic, alpha-chloroacrylic, and methacrylic acids; the methacrylates, such as methyl methacrylate, ethyl methacrylate, butyl metahacrylate, methoxymethyl methacrylate, betachloroethyl metacrylate and the corresponding esters of acrylic and alpha-chloroacrylic acids; vinyl bromide, vinyl chloride, vinyl fluoride, vinylidene chloride, vinylidene bromide, allyl chloride, 1-chloro-1-bromoethylene; methacrylonitrile; allyl alcohol; acrylamide and methacrylamide; methyl vinyl ketone; vinyl carboxylates such as vinyl formate, vinyl acetate, vinyl propionate, vinyl stearate, and vinyl benzoate; N-Vinylimides such as N-vinyl phthalimide and N-vinyl succinimide; methylene malonic esters; itaconic acid and itaconic esters; N-Vinylcarbazole; vinyl furan; alkyl vinyl ethers; vinyl sulfonic acids such as vinyl sulfonic acid, styrene sulfonic acid, methallylsulfonic acid, p-methoxyallyl benzene sulfonic acid, acrylamidomethylpropane sulfonic acid and their salts; ethylene alpha-, beta-dicarboxylic acids or their anhydrides or derivatives such as diethylcitraconate; diethylmesaconate; styrene, dibromostyrene; vinylnaphthalene; vinyl-substituted tertiary heterocyclic amines such as the vinylpyridines and alkyl-sbustituted vinylpyridines, for example, 2-methyl, 5-vinylpyridine, 2-vinylpyridine, 4-vinylpyridine, and the like; 1-vinylimidazole and alkyl-substituted 1-vinylimidazoles, such as 2-, 4-, or 5-methyl, 1-vinylimidazole; viinylpyrrolidone; vinylpiperidone; and other mono-olefinic copolymerizable monomeric materials. The acrylonitrile polymer or blends of polymers may contain varying qunatities of one or more comonomers as for example, a total of about 5, 10, 15, 20, 25, 30, 40, or 50 weight percent comonomer content based on the total acrylonitrile polymer composition. The polymers will have number average molecular weights ranging from about 16,000 to 45,000 as is known in the art. Such number average molecular weight values correspond to weight average molecular weights in the range of about 75,000 to about 225,000. Viscosity values, of course, will vary widely depending upon the polymerization procedure employed and the like.

The deterioration range for acrylonitrile polymer as used herein refers to the range of temperatures wherein acrylonitrile polymers undergo deterioration such as degradation or decomposition, usually evidenced by discoloration on exposure to such temperatures for the time normally required for fluidizing and extruding the polymer. Where the quality of the polymer in the product is not critical and some polymer degradation can be tolerated, the single phase fusion melt may be heated to more elevated temperatures into the degradation range in the practice of this invention, however, in general it is preferred to operate at lower temperatures to avoid degradation.

As indicated above, for processing, water is used in conjunction with the acrylonitrile polymer to provide a single phase fusion melt at a temperature above the boiling point of water at atmospheric pressure and below the deterioration point of the acrylonitrile polymer, the pressure being at least sufficient to maintain water in liquid state. In carrying out the process of the present invention, the quantity of water necessary to provide a single phase fusion melt can be readily determined by preparing a phase diagram of water and acrylonitrile polymer.

The present invention is described with particular reference to the accompanying drawings in which.

Figure 1:
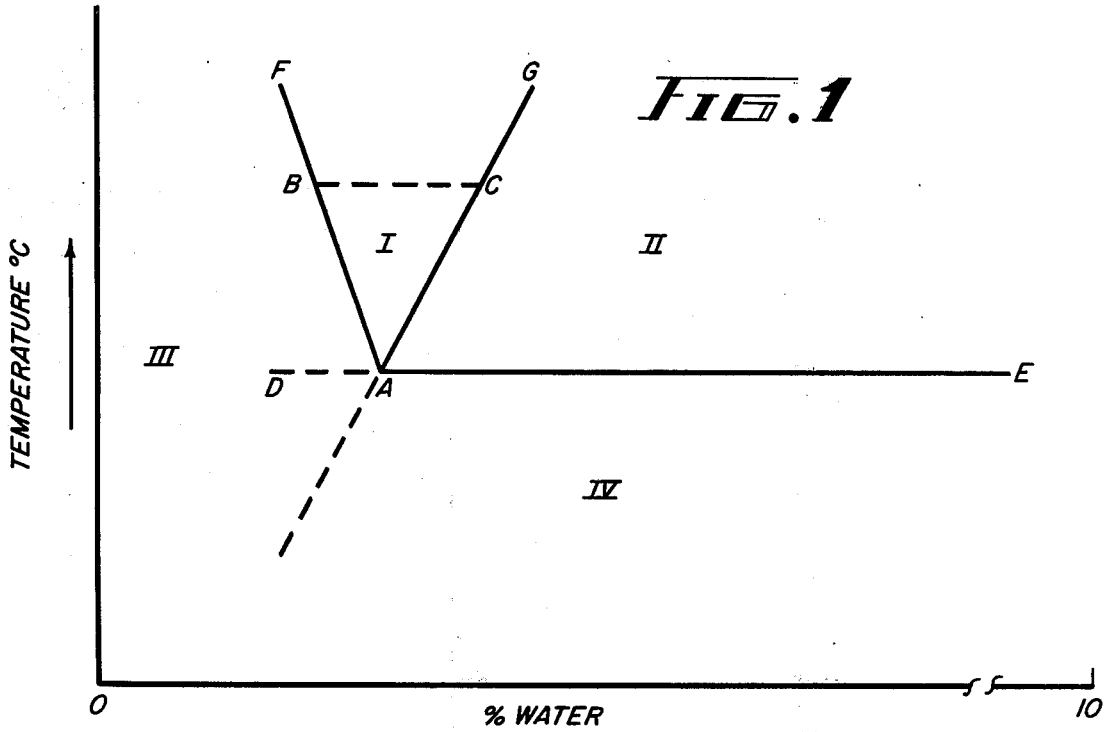
FIG. 1 is a typical phase diagram of an acrylonitrile polymer and water system wherein the abscissa represents the percent water in the acrylonitrile polymer-water system and the ordinate represents the temperature.

In constructing a phase diagram as illustrated by FIG. 1, point A is first located, then lines ABF and ACG are located, after which the preferred portion designated BC is determined to locate the conditions for spinning.

To determine point A, a series of samples of the polymer are exposed to saturated steam in an autoclave for five minutes each. Each sample is exposed to increasing temperatures. The melting point of the polymer in saturated steam is the minimum temperature where flow has occurred. The surface of melted polymer appears glassy and particles of polymer are strongly bonded together. The minimum temperature establishes the line DAE shown in FIG. 1, and is otherwise referred to as minimum single phase fusion melt melting point $T_m$.

Once the melting line DAE is known, the minimum water content necessary for fusion at that temperature is determined. This minimum water content and temperature is point A. At this point all water is hydrogen-bonded to the acrylonitrile polymer and no free water as a second phase exists. A sample of polymer mixed with a known quantity of water is placed into a steel cell equipped with a glass window. The cell is sealed to retain the pressure generated by the test. The cell is heated in an oil bath so that the sample can be observed at all times. In separate tests, samples containing various water-to-polymer ratios are placed in the cell and heated to the temperature indicated by line DAE. When excess water is present, two phases are visible when the polymer melts. Samples of progressively lower water contents are tested until a sample exhibiting only one phase is visible, establishing point A at the concentration. With further reduction in water-to-polymer ratio, melting will not occur at the temperature established by line DAE.

To determine the phase fusion region, it is necessary to establish the lines ABF and ACG as shown in FIG. 1. This is done by placing the steel cell samples of polymer whose water content in one case contains approximately 5–10% more or less water than the concentration at point A. Line ABF is determined by locating the point which represents the temperature and concentration at which the mixture of polymer and water having the lower amount of water melts into a single phase. Line ACG is established by locating the point at which the two-phase mixture of polymer and water having the greater amount of water becomes a single phase after passing through a two-phase liquid state. Since physical mixing is difficult to obtain in the sealed cell, this latter point may be time-consuming to obtain.

After locating point A and lines ABF and ACG, line BC is drawn at a temperature above the temperature of point A, depending upon the specific temperature at which extrusion is to be conducted. The extreme points B and C at the temperature selected represent, respectively, the minimum and maximum amounts of water that can be present in a single phase fusion melt at the temperature selected.

In FIG. 1, Region I represents those temperature-composition conditions wherein the acrylonitrile polymer and water exist as a single phase fusion melt wherein the water is hydrogen-bonded to the polymer. Region II represents those temperature-composition conditions wherein the polymer and water exist as two separate liquid phases, one being acrylonitrile polymer plus water and the other being free water. Region III represents single phase solid compositions of polymer and water. Region IV represents two-phase compositions, one phase being a solid phase of acrylonitrile polymer plus water and the other phase being a liquid water phase. Solid lines ABF, ACG, and AE are boundaries between Regions I and III, Regions I and II, and Regions II and IV, respectively, and point A is the minimum single phase fusion melt melting point, all of which are experimentally determined boundary conditions for any specific acrylonitrile polymer.

It will be noted that all of the additional phase diagrams are similar to the generic phase diagram of FIG. 1 although the location of point A and triangular area ABC shift due to differences in chemical composition of the different acrylonitrile polymers. For any given acrylonitrile polymer, the phase diagram can be constructed following the procedure outlined above to locate the water content useful at the particular temperature selected for extrusion.

Once the phase diagram of the selected acrylonitrile polymer and water has been determined, it is next necessary to select a temperature at which extrusion is to be effected. The extrusion temperature for processing the acrylonitrile polymer fiber can be about the minimum single phase fusion melt melting point $T_m$ but preferably not more than about 40° C. above the minimum single phase fusion melt melting point $T_m$. The particular temperature within the range specified may vary to the extent indicated due to variation in water content of the single phase fusion melt, the extent to which orientation stretching is desired, the manner in which extrusion is effected, the conditions of operation of the pressurized solidification zone, the nature of the acrylonitrile polymer, and other factors.

After the extrusion temperature is selected, the quantity of water that is to be used in the single phase fusion melt is determined. Having determined the temperature of extrusion, the range of water concentration which provides a single phase fusion melt at the temperature selected can be determined from the intercepts of the temperature line with the lines ABF and ACG. The intercept of the line ABF is equal to the minimum weight percent of water and the intercept of the line ACG is equal to the maximum weight percent of water. The exact water content within the range specified will be influenced by certain of the variables previously mentioned and can be readily optimized during operations using the suggested range as a guide.

A "single phase fusion melt", as that term is used herein, means an acrylonitrile polymer-water system which is substantially homogeneous with essentially all of the polymer and water constituting a single melt phase. This condition represents the situation where all of the water present can be bound by the acrylonitrile polymer and sufficient bonding has occurred to lower the melting point of the polymer below the temperature at which deterioration occurs.

The composition selected is then extruded at the specified extrusion temperature through spinnerette orifices directly into a steam-pressurized solidification zone wherein the conditions as previously described are maintained. The nascent extrudate will comprise a plurality of filaments for operating efficiency.

The process of the invention will next be described with reference to FIG. 3.

Figure 3:
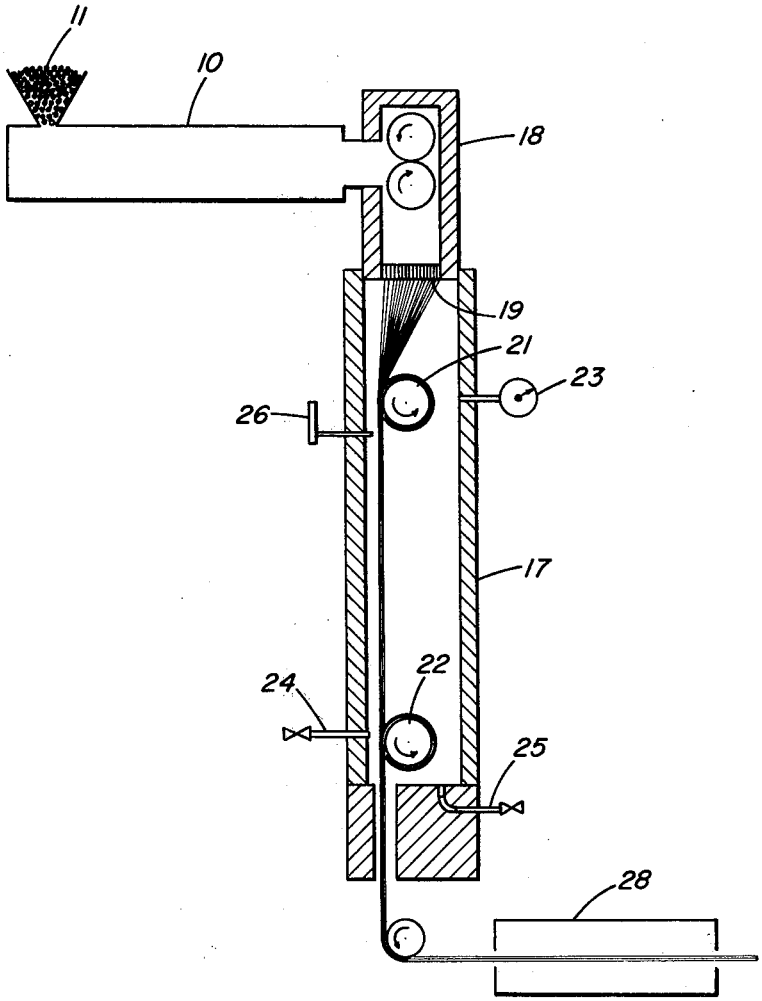
FIG. 3 is a schematic drawing illustrating an embodiment of the process of the present invention.

In FIG. 3, there is shown a schematic view of one procedure for carrying out the process of the present invention. Extruder 10 is supplied with polymer-water composition 11 which is compacted and melted on its way to spinnerette assembly 18 which is equipped with a gear pump to force the polymer melt through spinnerette orifices 19 and form a plurality of filament within solidification chamber 17. The filaments 20 are wrapped around take-up roll 21 which imparts a stretch ratio of up to about 5 to the filaments as they emerge from spinnerette orifices 19. The filaments 20 then continue to a second take-up roll 22 about which they are wrapped and which imparts a second level of stretch to the filaments, the total stretch imparted by both rolls 21 and 22 being at least equal to a stretch ratio of 25 relative to the linear speed of polymer melt through the spinnerette orifices 19. Steam enters solidification zone 17 through inlet 24 and condensate exits through outlet 25. Pressure gauge 23 and thermometer 26 indicate the steam conditions maintained on the solidification zone 17. The drawn filaments exit the solidification zone 17 through pressure seal 27 from whence they optionally proceed to a steam relaxation chamber 28 to effect suitable relaxation.

The optional relaxation to which the stretched fiber is subjected provides a desirable balance of textile properties in fibers provided by the process of the present invention. Relaxation is preferably conducted in saturated steam at temperatures in the range of about 105° C. to about 150° C. for time periods sufficient to effect a suitable degree of relaxation as reflected by filament shrinkage. The fiber being relaxed may be in a free-to-shrink condition or may be processed under conditions which control tension so as to preferably provide filament shrinkage in the range of about 20–35%.

In the conventional procedures for spinning acrylonitrile fibers, it is well known to employ certain additional steps for additional product modifications. Optionally, therefore, the process sequence described above may include additional steps, such as after-drawing, crimping, restretching, washing, treating with antistatic agents, antisoiling agents, fire-retardants, adhesion promoters, lubricants, etc., dyeing, post-treating chemically, as for cross-linking, staple cutting, and the like to produce such product modifications as these conventional steps are known to produce.

The invention is more fully illustrated by the examples which follow wherein all parts and percentages are by weight unless otherwise specified.

EXAMPLE 1

Figure 2A:
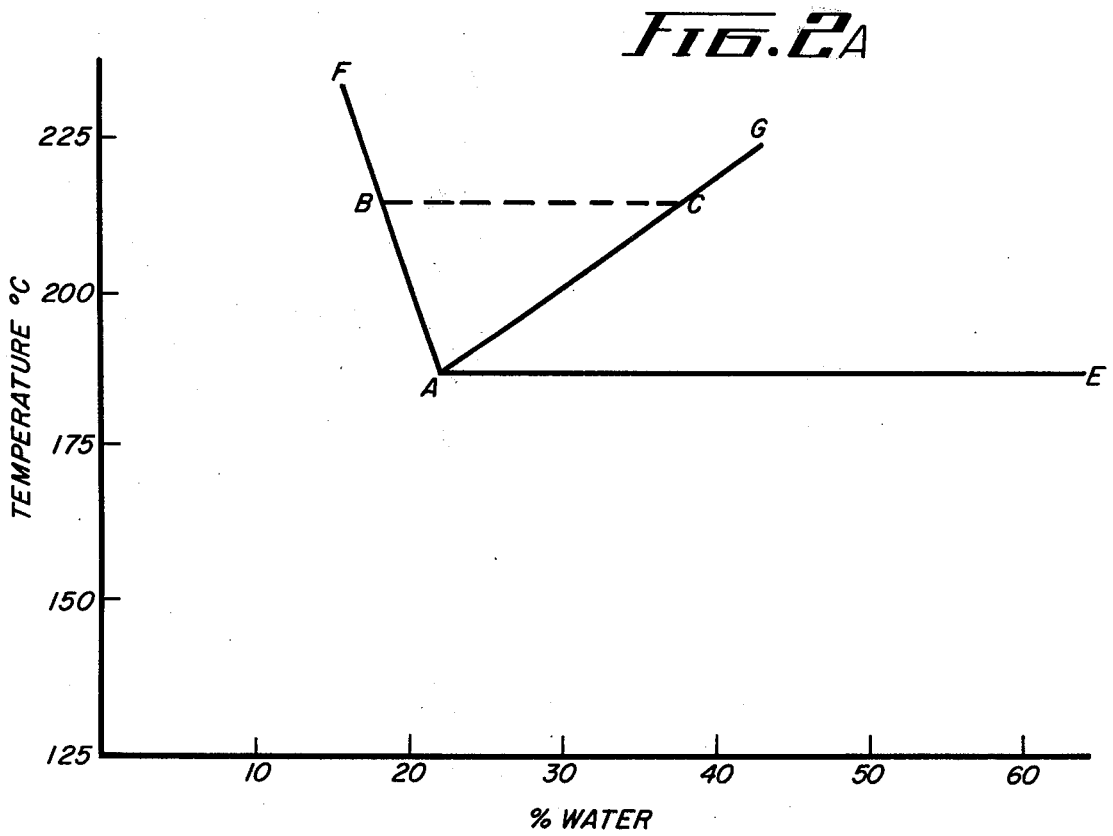
FIG. 2A represents the phase diagram of an acrylonitrile polymer-water system wherein the acrylonitrile polymer is a homopolymer of acrylonitrile.
Figure 2B:
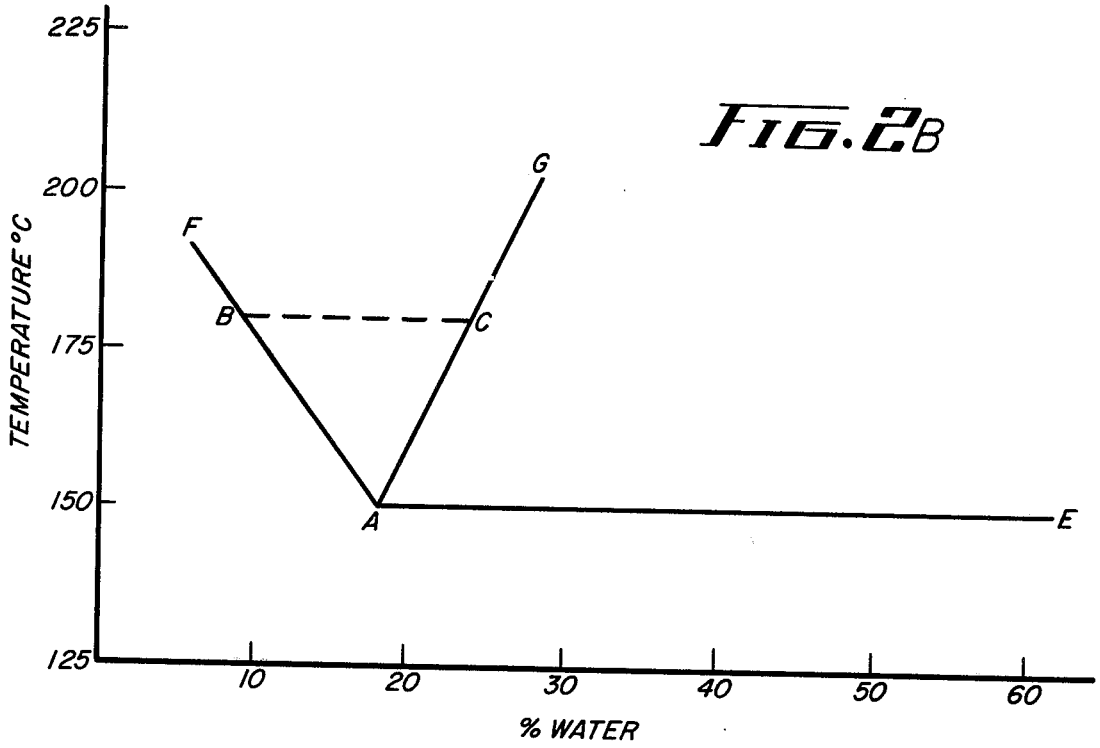
FIG. 2B represents the phase diagram of another acrylonitrile polymer-water system wherein the acrylonitrile polymer is a copolymer of 89.3% acrylonitrile and 10.7% methyl methacrylate by weight.
Figure 2C:
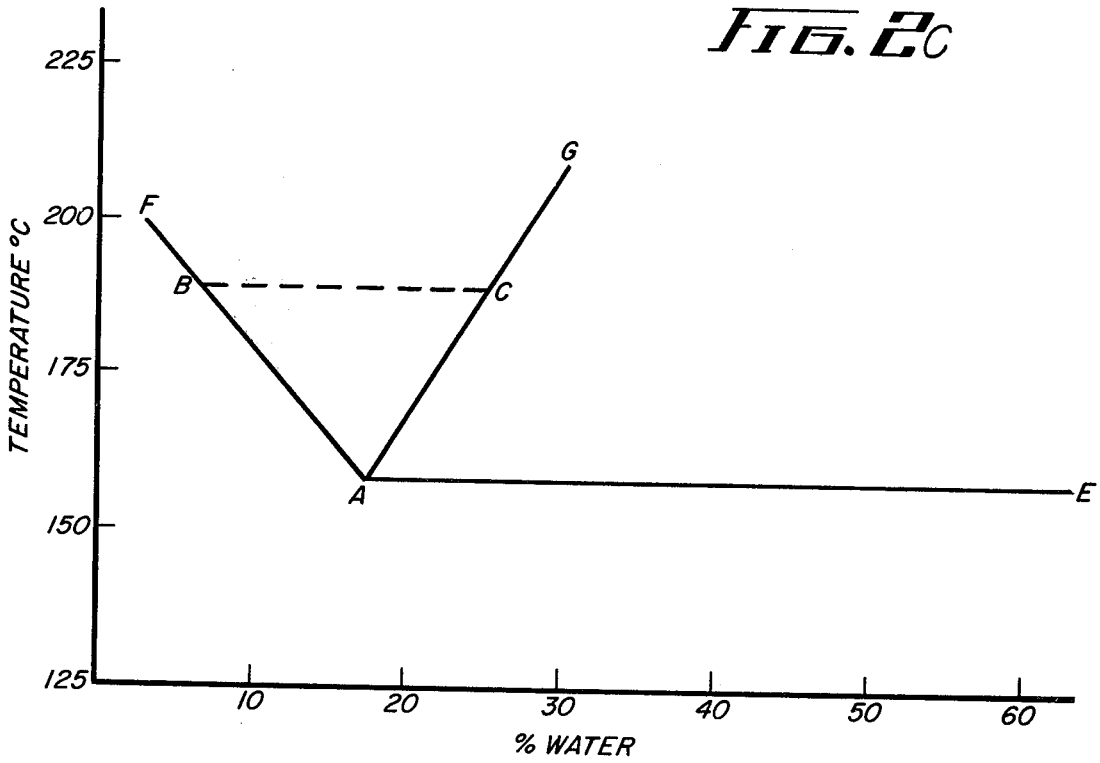
FIG. 2C represents the phase diagram of another acrylonitrile polymer-water system wherein the acrylonitrile polymer is a copolymer of 69.0% acrylonitrile, 25.0% vinylidine chloride, and 6% hydroxyethyl acrylate by weight.

The phase diagram for an acrylonitrile polymer-water system wherein the polymer was a copolymer of 89.3% acrylonitrile and 10.7% methyl methacrylate and had a number average molecular weight of 18,000 was determined as described above. The resulting phase diagram illustrated in FIG. 2B shows that a single phase fusion melt region of temperature and composition exist in the triangular area ABC thereon which can usefully be melt-spun into fiber. Having determined the phase diagram for mixtures of this polymer and water, as shown in FIG. 2B, the following melt-spinning was conducted using apparatus substantially as schematically illustrated in FIG. 3.

To 82.3 parts of the acrylonitrile polymer (bone dry basis) were added 17.6 parts of water. The polymer-water mixture was processed into a single phase fusion melt and extruded through a spinnerette having 5,016 orifices, each of 200 microns diameter and a capillary length to diameter ratio of 2.2. Extrusion was conducted at 176° C. and the extrudate issued directly into a solidification zone maintained at 25 psig (130° C.) with saturated steam. Orientation stretch was effected in two stages employing a stretch ratio of 3.2 in a first stage and of 13.6 in a second stage to provide a total stretch ratio of 43.5, relative to the linear flow of fusion melt through the spinnerette. The extrudate which emerged from the solidification zone was relaxed in saturated steam at a pressure of 18 psig (124° C.) and a shrinkage of 28% occurred. The fiber before relaxation was 5.4 denier/-filament and 7.2 denier/filament after relaxation. Relaxed fiber properties were as follows:

| | |
|---|---|
| Straight tenacity grams/denier | 6.5 |
| Straight elongation % | 33 |
| Loop tenacity grams/denier | 4.2 |
| Loop elongation % | 24 |

EXAMPLE 2

The single phase fusion melt obtained as in Example 1 was extruded through a spinnerette having 16 orifices each of 305 microns in diameter and having a capillary length to diameter ratio of 2.0. Extrusion was conducted at 177° C. and the filaments issued directly into a solidification zone maintained at 32 psig (136° C.) with saturated steam. Stretching was accomplished in two stages of stretch but the stretch ratios conducted in the two stages varied as indicated in the table which follows which also shows the straight tenacity value of the fiber obtained after drying.

| Run | Stretch Ratio 1st Stage | Stretch Ratio 2nd Stage | Total Stretch | Fiber Tenacity (grams/denier) |
|---|---|---|---|---|
| 1 | 3.5 | 6.4 | 25 | 7.0 |
| Comparative A | 8.8 | 2.8 | 25 | 2.5 |
| Comparative B | 18.3 | 1.4 | 25 | 2.1 |
| Comparative C | 25.0 | — | 25 | 2.0 |

These data show that when the filaments are processed using only a single stretch or when they are processed using two stages of stretch in which the stretch ratio in the first stage exceeds about 5, the fiber tenacity is considerably below that obtained when two stages of stretch are used and the first stage of stretch is below about 5. From additional considerations, such as ease of processing, continuous processability, processing speed, and the like, it is generally preferable to conduct the first stage of stretching at a stretch ratio of less than about 5 and to conduct subsequent stretching at a stretch ratio greater than 5. When subsequent stretching involves more than one stage, the product of the several stages should exceed the stretch ratio of the first stage. Thus, one way to achieve a total stretch of 27× in accordance with the present invention would be in a first stage at 3× and a second stage at 9× whereupon the total stretch is 3×9 or 27×. Alternatively, this same stretch could be achieved in a first stage of 3× and two subsequent stretches each of 3×, thus yielding 3×3×3 or 27× in which the subsequent stages 3×3 or 9× exceed the first stage of 3×.

EXAMPLE 3

The procedure of Example 1 was followed in every material detail except that the stretched extrudate was relaxed at 12.5 psig (118° C.) and 20% shrinkage occurred. The fiber before relaxation was 5.4 d/f and 6.6 d/f after relaxation. Relaxed fiber properties were as follows:

| | |
|---|---|
| Straight tenacity g/d | 5.6 |
| Straight elongation % | 25 |
| Loop tenacity g/d | 3.6 |
| Loop elongation % | 18 |

EXAMPLE 4

The procedure of Example 1 was followed in general except as indicated. The acrylonitrile polymer contained 88.67% acrylonitrile and 11.33% methyl acrylate and had a number average molecular weight of 20,500. The melt contained 15.7 parts water and 84.3 parts polymer. The temperature of the melt as spun was 200° C. The pressure of saturated steam in the solidification zone was 20 psig. The stretch ratio in the first stage was 2.1 and 18.8 in the second stage for a total stretch ratio of 39.4. The stretched fiber was relaxed in saturated steam at 11 psig and 34% shrinkage occurred. The fiber was of 6.2 d/f as produced and of 9.4 d/f after relaxation. Fiber properties were as follows:

| | |
|---|---|
| Straight tenacity g/d | 5.9 |
| Straight elongation % | 44 |
| Loop tenacity g/d | 3.8 |
| Loop elongation % | 32 |

EXAMPLE 5

Again the general procedure of Example 1 was followed with the following changes. The polymer contained 90.8% acrylonitrile and 9.2% methyl acrylate and had a number average molecular weight of 17,500. The melt contained 18.4 parts water and 81.6 parts polymer. The temperature of the melt as spun was 181° C. The pressure of saturated steam in the solidification zone was 22 psig. The stretch ratio in the first stage was 2.0 and 12.5 in the second stage for a total stretch ratio of 25. The stretched fiber was relaxed in saturated steam at 24 psig and 34% shrinkage occurred. The fiber was of 6.2 d/f as produced and 9.4 d/f after relaxation. Fiber properties were as follows:

| | |
|---|---|
| Straight tenacity g/d | 5.9 |
| Straight elongation % | 44 |
| Loop tenacity g/d | 3.8 |
| Loop elongation % | 32 |

EXAMPLE 6

The procedure of Example 5 was followed in every material detail except for the following. The number average molecular weight of the polymer was 17,400. The melt contained 16.8 parts water and 83.2 parts polymer. The melt was spun at 180° C. The fiber exhibited 35% shrinkage upon relaxation. The fiber was of 9.2 d/f as produced and 14.2 d/f after relaxation. Fiber properties were as follows:

| | |
|---|---|
| Straight tenacity g/d | 6.4 |
| Straight elongation % | 31 |
| Loop tenacity g/d | 4.5 |
| Loop elongation % | 18 |

EXAMPLE 7

The general procedure of Example 1 was again followed with the following exceptions. The polymer contained 6.9% methyl acrylate and 93.1% acrylonitrile and had a number average molecular weight of 17,000. The melt contained 16.4 parts water and 83.6 parts polymer and was spun at 178° C. The pressure of saturated steam in the solidification zone was 22 psig. The stretch ratio was 2.0 in the first stage and 12.5 in the second stage for a total stretch ratio of 25. The fiber was relaxed in saturated steam at 30 psig and 25% shrinkage occurred. The fiber was 8.2 d/f as produced and 10.9 d/f after relaxation. Fiber properties were as follows:

| | |
|---|---|
| Straight tenacity g/d | 8.1 |
| Straight elongation % | 25 |
| Loop tenacity g/d | 4.4 |
| Loop elongation % | 15 |

COMPARATIVE EXAMPLE A

In this example, a piston extruder was used to prepare a single filament, the polymer melt being extruded through an orifice of 16 mils diameter and 128 mils orifice length. The polymer employed contained 10.7 weight percent methyl methacrylate and 89.3% acrylonitrile and had a number average molecular weight of 18,000. The melt contained 82 parts polymer and 18 parts water and was extruded at 154° C. The pressure of saturated steam in the solidification zone into which the melt was directly extruded was 38 psig. Stretching was effected in a single stage at a stretch ratio of 85. The fiber was relaxed in saturated steam at 127° C. and 23% shrinkage occurred. The fiber was of 15 d/f as produced and of 19.5 d/f after relaxation. Fiber properties were as follows:

| | |
|---|---|
| Straight tenacity g/d | 3.5 |
| Straight elongation % | 43 |
| Loop tenacity g/d | 1.98 |
| Loop elongation % | 19 |

Comparing these fiber properties with those of the fiber obtained in Example 1, it can be seen that the process of the present invention provides a better balance of fiber properties at lower total stretch ratio.

COMPARATIVE EXAMPLE B

This example illustrates the process of U.S. Pat. No. 3,984,601 (Blickenstaff) using in Part A, acrylonitrile polymer and water to obtain a fusion melt spinning composition and in Part B, acrylonitrile polymer, water, and ethylene carbonate to obtain a fusion melt spinning composition, ethylene carbonate being a compatible solvent for the polymer. In each part, the same polymer is employed and has the composition 93.63% acrylonitrile, 6% methyl acrylate, and 0.37% sodium styrene sulfonate, with a number average molecular weight of 18,000.

Part A

The polymer is mixed with water at a ratio of 100/26.5, respectively. The mixture is fed to an extruder during which processing it is converted to a homogeneous melt. The melt is delivered from the extruder to a spinnerette having orifices of 0.15 mm diameter and 0.15 mm length. The melt at 172° C. is extruded into a conditioning chamber 20 cm. long which is fed room temperature air to maintain a pressure of 20 psig to result in a temperature of 140°-150° C. The continuous filament spun is wound at 96 m./min. The filament obtained is then subjected in a separate operation to drawing in saturated steam at 120° C. to three draw ratios, 6×, 8×, and 12×, corresponding to 600%, 800%, and 1200% of its as-spun length, respectively. The resulting single filament is boiled off and the properties determined are tabulated below.

Part B

The procedure of Part A above is followed in all essential details except that the copolymer is mixed with water and ethylene carbonate in the ratio of 100/25.8/3.23, respectively; the conditioning chamber is 15 cm. long; and the temperature therein is 140° C.; and the stretch ratios were 6×, 8×, and 11.5×. Boiled-off filament properties are also given in the tabulation below.

FIBER PROPERTIES

| Filaments Of Part | Draw Ratio | Denier | Straight Tenacity | Straight Elongation | Loop Tenacity | Loop Elongation |
|---|---|---|---|---|---|---|
| A | 6 | 17 | 3.67 | 26% | 0.67 g/d | 1.6 |
| A | 8 | 11.9 | 4.56 | 22.8 | 0.83 | 2.1 |
| A | 12 | 8.2 | 5.24 | 19.6 | 0.81 | 1.7 |
| B | 6 | 9.9 | 3.96 | 28.4 | 0.8 | 2.0 |
| B | 8 | 7.6 | 4.28 | 24.1 | 1.50 | 9.0 |

-continued

| Filaments Of Part | Draw Ratio | Denier | FIBER PROPERTIES Straight Tenacity | Straight Elongation | Loop Tenacity | Loop Elongation |
|---|---|---|---|---|---|---|
| B | 11.5 | 5.5 | 4.99 | 21.9 | 1.30 | 6.9 |

A comparison of the loop properties of fibers of Part A with those of the fiber of Example 4 clearly show the improved properties obtained by the present invention when no polymer solvent is employed. Similar comparisons of the loop properties of fibers of Part B with those of the fiber of Example 4 also show that fiber properties obtained by the process of the present invention using no polymer solvent are better than those obtained by the reference using polymer solvent.

We claim:

1. In a process for melt-spinning an acrylonitrile polymer which comprises extruding a single phase fusion melt of an acrylonitrile copolymer having a number average molecular weight in the range of about 16,000–45,000 and water through a spinnerette to form a plurality of filaments directly into a steam-pressurized solidification zone wherein the temperature, pressure, and saturation of steam are maintained under conditions, such that said filaments solidify, remain in a stretchable state sufficient to achieve a total stretch ratio of at least about 25, relative to the linear flow of said fusion melt through said spinnerette, and the amount of water retained in said filaments is sufficient to maintain the filaments in a plastic state and stretching said filaments while in said solidification zone at a total stretch ratio of at least about 25, relative to the linear flow of said fusion melt through said spinnerette to provide fiber, the improvement which comprises accomplishing said stretching being a stretch ratio between about 1.5 and about 3.5 and the subsequent stage being at a stretch ratio greater than that of said first stage.

2. The process of claim 1 wherein said filaments are relaxed subsequent to said stretching in steam to provide filament shrinkage in the range of about 20–35%.

3. The process of claim 1 wherein the steam pressure in said solidification zone in the range of about 10% to about 70% of the steam pressure corresponding to minimum melting point of the polymer-water composition.

4. The process of claim 1 wherein the total stretch ratio is in the range of about 35–150.

5. The process of claim 1 wherein the fiber obtained has a denier per filament of about 1 to 20.

* * * * *